US008376515B2

(12) United States Patent
Silverbrook

(10) Patent No.: US 8,376,515 B2
(45) **Date of Patent: *Feb. 19, 2013**

(54) PAGEWIDTH PRINTHEAD ASSEMBLY INCORPORATING LAMINATED SUPPORT STRUCTURE

(75) Inventor: Kia Silverbrook, Balmain (AU)

(73) Assignee: Zamtec Ltd, Dublin (IE)

( * ) Notice: Subject to any disclaimer, the term of this patent is extended or adjusted under 35 U.S.C. 154(b) by 373 days.

This patent is subject to a terminal disclaimer.

(21) Appl. No.: 12/850,612

(22) Filed: Aug. 4, 2010

(65) Prior Publication Data

US 2010/0295899 A1 Nov. 25, 2010

Related U.S. Application Data

(63) Continuation of application No. 11/764,778, filed on Jun. 18, 2007, now Pat. No. 7,771,013, which is a continuation of application No. 11/144,810, filed on Jun. 6, 2005, now Pat. No. 7,246,879, which is a continuation of application No. 10/882,765, filed on (Continued)

(51) Int. Cl.
*B41J 2/155* (2006.01)

(52) U.S. Cl. ..... 347/42; 347/49; 347/65; 347/54; 347/13

(58) Field of Classification Search ..... 347/49, 347/42, 65, 54, 13
See application file for complete search history.

(56) References Cited

U.S. PATENT DOCUMENTS 4,023,184 A 5/1977 Stillman, Jr.
5,160,945 A 11/1992 Drake
5,506,608 A 4/1996 Marler et al.
5,528,272 A 6/1996 Quinn et al.
5,686,949 A 11/1997 Swanson et al.
5,830,565 A 11/1998 Budnaitis
5,847,327 A 12/1998 Fischer et al.
6,357,865 B1 3/2002 Kubby et al.
6,592,205 B2 7/2003 Beerling et al.
6,676,245 B2 1/2004 Silverbrook
6,676,250 B1 1/2004 Silverbrook et al.
6,799,836 B2 10/2004 Silverbrook
6,820,966 B1 11/2004 Drury et al.
6,935,718 B2 8/2005 Silverbrook
6,938,983 B2 9/2005 Silverbrook
6,942,319 B2 9/2005 Silverbrook
6,959,974 B2 11/2005 Silverbrook
6,959,975 B2 11/2005 Silverbrook (Continued)

FOREIGN PATENT DOCUMENTS

EP 0841166 A 5/1998
JP 63-261863 10/1988

(Continued)

OTHER PUBLICATIONS

Aden et al., "The Third Generation HP Thermal Ink Jet Printhead", Feb. 1994, HP Journal Publication, pp. 41-45.

(Continued)

*Primary Examiner* — Matthew Luu
*Assistant Examiner* — Henok Legesse
(74) *Attorney, Agent, or Firm* — Cooley LLP

(57) ABSTRACT

A printhead assembly extending in pagewidth direction includes an elongate support beam; an elongate shell at least partially enclosing and restraining the support beam; and a plurality of printhead integrated circuits mounted to the support beam and substantially aligned with one another in the pagewidth direction. The support beam has formed therein at least one printing fluid reservoir arranged in fluid communication with the plurality of printhead integrated circuits.

8 Claims, 1 Drawing Sheet

Related U.S. Application Data

Jul. 2, 2004, now Pat. No. 6,959,974, which is a continuation of application No. 10/713,089, filed on Nov. 17, 2003, now Pat. No. 6,799,836, which is a continuation of application No. 10/129,503, filed as application No. PCT/AU01/00239 on Mar. 6, 2001, now Pat. No. 6,676,245.

(56) References Cited

U.S. PATENT DOCUMENTS

| | | | |
|---|---|---|---|
| 7,021,740 | B2 | 4/2006 | Silverbrook |
| 7,029,097 | B2 | 4/2006 | Silverbrook |
| 7,159,972 | B2 | 1/2007 | Silverbrook et al. |
| 7,246,879 | B2 | 7/2007 | Silverbrook |
| 7,284,825 | B2 | 10/2007 | Silverbrook |
| 7,314,266 | B2 | 1/2008 | Silverbrook |
| 7,467,848 | B2 | 12/2008 | Silverbrook |
| 7,537,323 | B2 | 5/2009 | Silverbrook |
| 7,549,724 | B2 | 6/2009 | Silverbrook |
| 2002/0180835 | A1 | 12/2002 | Boyd et al. |
| 2004/0095413 | A1 | 5/2004 | Silverbrook |
| 2004/0095414 | A1 | 5/2004 | Silverbrook |
| 2004/0095429 | A1 | 5/2004 | Silverbrook |
| 2005/0219317 | A1 | 10/2005 | Silverbrook |
| 2005/0225605 | A1 | 10/2005 | Silverbrook |
| 2007/0024666 | A1 | 2/2007 | Silverbrook |
| 2007/0035595 | A1 | 2/2007 | Silverbrook |
| 2007/0046729 | A1 | 3/2007 | Silverbrook |
| 2007/0076062 | A1 | 4/2007 | Silverbrook |
| 2008/0024543 | A1 | 1/2008 | Silverbrook |
| 2008/0024544 | A1 | 1/2008 | Silverbrook |
| 2008/0100680 | A1 | 5/2008 | Silverbrook |
| 2008/0211857 | A1 | 9/2008 | Silverbrook |

FOREIGN PATENT DOCUMENTS

| | | | |
|---|---|---|---|
| JP | 02-34577 | | 2/1990 |
| JP | 05-138885 | | 6/1993 |
| JP | 06-087213 | A | 3/1994 |
| JP | 06-122197 | | 5/1994 |
| JP | 07-266566 | | 10/1995 |
| JP | 10-157105 | | 6/1998 |
| JP | 10-157105 | A | 6/1998 |
| JP | 11-010861 | A | 1/1999 |
| JP | 2000-263768 | A | 9/2000 |

OTHER PUBLICATIONS

Charmchi et al, "A BiCMOS Thermal Head Intelligent Driver with Density Controllers for Full-Tone Redition Printers", Apr. 1988, IEEE Article, vol. 23, No. 2, pp. 437-441.

Diepold et al., "A Micro-machined continuous ink jet printhead for high resolution printing", 1998, IOP Publication, No. 8, pp. 144-147.

Tsumura et al. 'Thermal Characteristics of DOT-MATRIX Print Heads', 1988, IEEE Article, pp. 132-136.

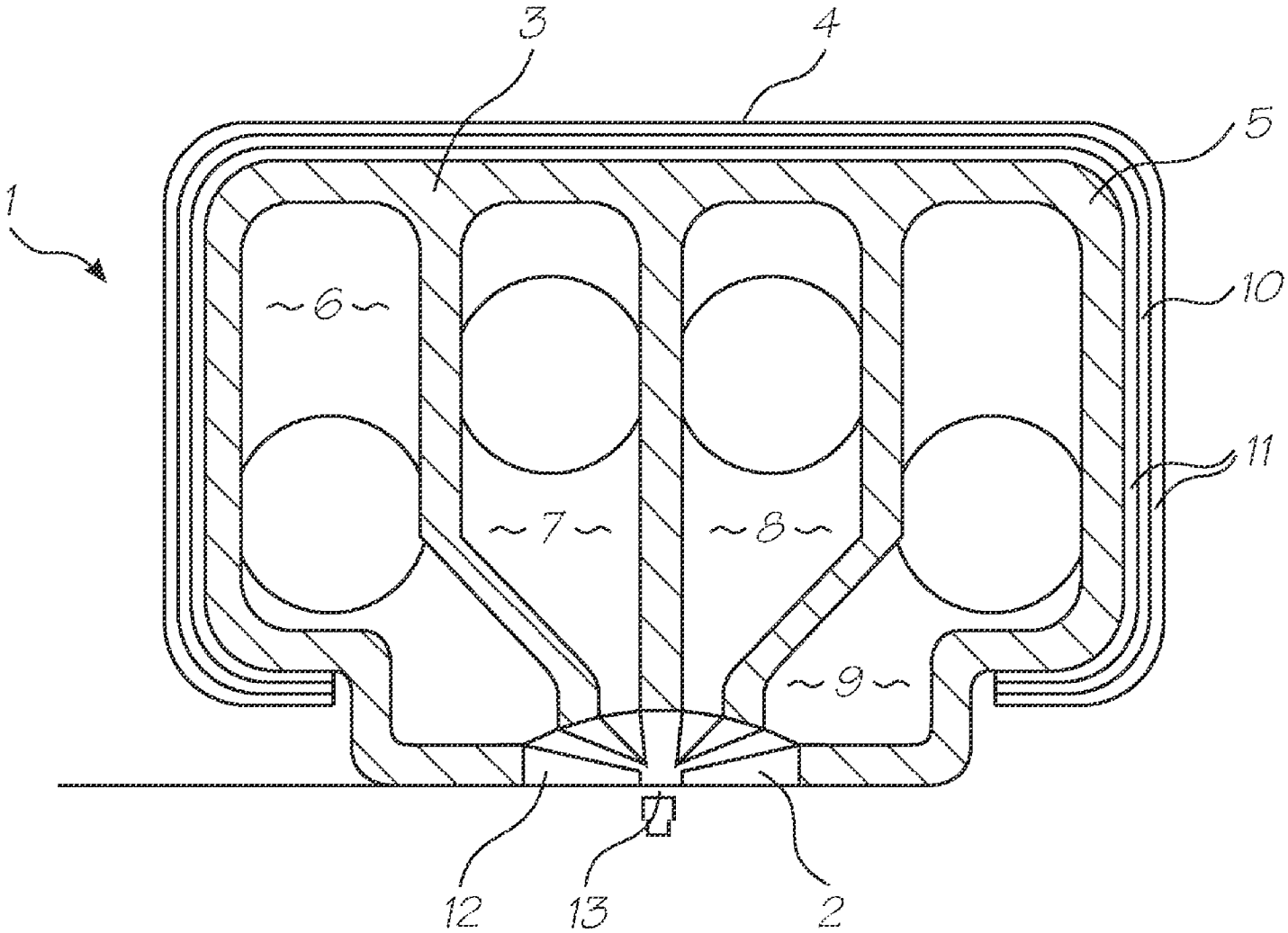
1
3
4
5
6
7
8
9
10
11
12
13
2

PAGEWIDTH PRINTHEAD ASSEMBLY INCORPORATING LAMINATED SUPPORT STRUCTURE

CROSS REFERENCE TO RELATED APPLICATION

The present application is a continuation of U.S. application Ser. No. 11/764,778 filed Jun. 18, 2007, which is a continuation of U.S. application Ser. No. 11/144,810 filed Jun. 6, 2005, now issued U.S. Pat. No. 7,246,879, which is a continuation of U.S. application Ser. No. 10/882,765 filed Jul. 2, 2004, now issued U.S. Pat. No. 6,959,974, which is a continuation of U.S. application Ser. No. 10/713,089 filed Nov. 17, 2003, now issued as U.S. Pat. No. 6,799,836, which is a continuation of U.S. application Ser. No. 10/129,503 filed May 6, 2002, now issued as U.S. Pat. No. 6,676,245, which is a 371 of PCT/AU01/00239 filed on Mar. 6, 2001 all of which are herein incorporated by reference.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00238 (deriving priority from Australian Provisional Patent Application No. PQ6059).

FIELD OF THE INVENTION

The present invention relates to printers, and in particular to digital inkjet printers.

BACKGROUND OF THE INVENTION

Recently, inkjet printers have been developed which use printheads manufactured by micro-electro mechanical system(s) (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printheads do not traverse back and forth across the page like conventional inkjet printheads, which allows the paper to be fed past the printhead more quickly.

To reduce production and operating costs, the printheads are made up of separate printhead modules mounted adjacent each other on a support beam in the printer. To ensure that there are no gaps or overlaps in the printing produced by adjacent printhead modules it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up during printhead operation. Furthermore, if the printhead modules are accurately aligned when the support beam is at the equilibrium operating temperature, there may be unacceptable misalignments in any printing before the beam has reached the operating temperature. Even if the printhead is not modularized, thereby making the alignment problem irrelevant, the support beam and printhead may bow because of different thermal expansion characteristics. Bowing across the lateral dimension of the support beam does little to affect the operation of the printhead. However, as the length of the beam is its major dimension, longitudinal bowing is more significant and can affect print quality.

SUMMARY OF THE INVENTION

According to an aspect of the present disclosure, a printhead assembly extending in pagewidth direction includes an elongate support beam; an elongate shell at least partially enclosing and restraining the support beam; and a plurality of printhead integrated circuits mounted to the support beam and substantially aligned with one another in the pagewidth direction. The support beam has formed therein at least one printing fluid reservoir arranged in fluid communication with the plurality of printhead integrated circuits.

BRIEF DESCRIPTION OF THE DRAWING

A preferred embodiment of the invention will now be described, by way of example only, with reference to the accompanying drawing in which:

FIG. 1 is a schematic cross section of a printhead assembly according to the present invention.

DETAILED DESCRIPTION OF THE PREFERRED EMBODIMENTS

Referring to the FIGURE, the printhead assembly 1 includes a printhead 2 mounted to a support member 3. The support member 3 has an outer shell 4 and a core element 5 defining four separate ink reservoirs 6, 7, 8 and 9. The outer shell 4 is a hot rolled trilayer laminate of two different metals. The first metal layer 10 is sandwiched between layers of the second metal 11. The metals forming the trilayer shell are selected such that the effective coefficient of thermal expansion of the shell as a whole is substantially equal to that of silicon even though the coefficients of the core and the individual metals may significantly differ from that of silicon. Provided that the core or one of the metals has a coefficient of thermal expansion greater than that of silicon, and another has a coefficient less than that of silicon, the effective coefficient can be made to match that of silicon by using different layer thicknesses in the laminate.

Typically, the outer layers 11 are made of invar which has a coefficient of thermal expansion of $1.3\times10^{-6}$ m/° C. The coefficient of thermal expansion of silicon is about $2.5\times10^{-6}$ m/° C. and therefore the central layer must have a coefficient greater than this to give the support beam an overall effective coefficient substantially the same as silicon.

The printhead 2 includes a micro moulding 12 that is bonded to the core element 5. A silicon printhead chip 13 constructed using MEMS techniques provides the ink nozzles, chambers and actuators.

As the effective coefficient of thermal expansion of the support beam is substantially equal to that of the silicon printhead chip, the distortions in the printhead assembly will be minimized as it heats up to operational temperature. Accordingly, if the assembly includes a plurality of aligned printhead modules, the alignment between modules will not change significantly. Furthermore, as the laminated structure of the outer shell is symmetrical in the sense that different metals are symmetrically disposed around a central layer, there is no tendency of the shell to bow because of greater expansion or contraction of any one metal in the laminar structure. Of course, a non-symmetrical laminar structure could also be prevented from bowing by careful design of the lateral cross section of the shell.

The invention has been described herein by way of example only. Skilled workers in this field will readily recognise that the invention may be embodied in many other forms.

I claim:

1. A printhead assembly extending in pagewidth direction, the printhead assembly comprising:

an elongate support beam;

an elongate shell at least partially enclosing and restraining the support beam; and a plurality of printhead integrated circuits mounted to the support beam and substantially aligned with one another in the pagewidth direction, wherein the support beam has formed therein at least one printing fluid reservoir arranged in fluid communication with the plurality of printhead integrated circuits.

2. A printhead assembly as claimed in claim 1, wherein the laminated structure has an effective coefficient of thermal expansion substantially equal to that of the plurality of printhead integrated circuits.

3. A pagewidth printhead assembly as claimed in claim 1, wherein the shell is a laminated structure.

4. A printhead assembly as claimed in claim 3, wherein the laminated structure has an odd number of laminates arranged so that the outer laminates have the same coefficient of thermal expansion as one another and a different coefficient of thermal expansion to that of the inner laminates.

5. A printhead assembly as claimed in claim 1, wherein the coefficient of thermal expansion of each laminate is different to that of the printhead integrated circuits.

6. A printhead assembly as claimed in claim 1, wherein the outer and inner laminates are formed of different metals.

7. A printhead assembly as claimed in claim 5, wherein the outer laminates are formed of invar.

8. A printhead assembly as claimed in claim 1, wherein the printhead integrated circuits are fabricated from silicon and constructed using micro-electromechanical techniques.

* * * * *